US011401849B2

(12) United States Patent
Igarashi et al.

(10) Patent No.: US 11,401,849 B2
(45) Date of Patent: Aug. 2, 2022

(54) INTERNAL COMBUSTION ENGINE EXHAUST PURIFICATION DEVICE

(71) Applicant: ISUZU MOTORS LIMITED, Tokyo (JP)

(72) Inventors: Osamu Igarashi, Fujisawa (JP); Naofumi Ochi, Fujisawa (JP); Takaaki Noda, Fujisawa (JP); Shirou Ochiai, Fujisawa (JP); Hiromichi Yamada, Fujisawa (JP)

(73) Assignee: ISUZU MOTORS LIMITED, Tokyo (JP)

( * ) Notice: Subject to any disclaimer, the term of this patent is extended or adjusted under 35 U.S.C. 154(b) by 97 days.

(21) Appl. No.: 16/956,509

(22) PCT Filed: Dec. 7, 2018

(86) PCT No.: PCT/JP2018/045070
§ 371 (c)(1),
(2) Date: Jun. 19, 2020

(87) PCT Pub. No.: WO2019/124117
PCT Pub. Date: Jun. 27, 2019

(65) Prior Publication Data

US 2021/0010402 A1 Jan. 14, 2021

(30) Foreign Application Priority Data

Dec. 20, 2017 (JP) ..... JP2017-244237

(51) Int. Cl.
*F01N 3/00* (2006.01)
*F01N 3/025* (2006.01)
(Continued)

(52) U.S. Cl.
CPC ..... *F01N 3/0253* (2013.01); *F01N 9/002* (2013.01); *F02M 55/025* (2013.01);
(Continued)

(58) Field of Classification Search
CPC .... F01N 3/0253; F01N 9/002; F01N 2900/18; F01N 2610/146; F02M 59/44
(Continued)

(56) References Cited

U.S. PATENT DOCUMENTS 4,379,387 A * 4/1983 Iizuka ..... F02D 43/00 123/198 F
9,670,818 B2 * 6/2017 Mutti, Jr. ..... F01N 3/2066
(Continued)

FOREIGN PATENT DOCUMENTS

EP 1176292 A1 1/2002
JP H11062686 A 3/1999
(Continued)

OTHER PUBLICATIONS

English translation of Japanese Patent Application Publication No. JP 2003-203732A (Year: 2003).*
(Continued)

*Primary Examiner* — Jason D Shanske
(74) *Attorney, Agent, or Firm* — Procopio, Cory, Hargreaves & Savitch LLP

(57) ABSTRACT

An internal combustion engine exhaust purification device includes a filter which is disposed in an exhaust path and collects particulate matter in exhaust gas, an injection valve which is disposed upstream of the filter in the exhaust path and injects fuel into the exhaust path, a fuel pump which supplies a fuel to the injection valve, a shut-off valve which is interposed between the fuel pump and the injection valve, and selectively shuts off a fuel supply from the fuel pump to the injection valve, and a control unit which controls the injection valve and the shut-off valve. The control unit closes the shut-off valve when the control unit detects an
(Continued)

opened adherence failure of the injection valve and detects an abnormal temperature rise of the filter during regeneration of the filter.

4 Claims, 2 Drawing Sheets

(51) Int. Cl.
*F01N 9/00* (2006.01)
*F02M 55/02* (2006.01)
*F02M 59/44* (2006.01)

(52) U.S. Cl.
CPC ..... *F02M 59/44* (2013.01); *F01N 2900/1602* (2013.01); *F01N 2900/18* (2013.01)

(58) Field of Classification Search
USPC ..... 60/277
See application file for complete search history.

(56) References Cited

U.S. PATENT DOCUMENTS

2004/0261401 A1* 12/2004 Ohkl ..... F02D 41/025 60/285
2007/0295001 A1* 12/2007 Newman ..... F02M 26/42 60/280
2009/0255234 A1* 10/2009 Haeberer ..... F01N 3/0842 60/295
2010/0011748 A1* 1/2010 Yokota ..... F01N 11/00 60/286
2010/0018594 A1* 1/2010 Bruhn ..... F01N 3/2066 137/565.11
2010/0139254 A1* 6/2010 Sebestyen ..... F01N 11/00 60/286
2012/0020857 A1* 1/2012 Isada ..... F01N 3/208 423/212
2014/0202139 A1* 7/2014 Qi ..... F01N 3/035 60/295
2016/0298568 A1* 10/2016 Giroud ..... F01N 3/36

FOREIGN PATENT DOCUMENTS

JP 2002038940 A 2/2002
JP 2002129945 A * 5/2002
JP 2003254047 A 9/2003
JP 2003293732 A 10/2003
JP 2007154755 A 6/2007
JP 2016089775 A 6/2007
JP 2011256850 A 12/2011
JP 2014159780 A 9/2014
JP 2015031187 A 2/2015
JP 5796278 B2 * 10/2015

OTHER PUBLICATIONS

English translation of Japanese Patent Application Publication No. JP 2002-129945A (Year: 2002).*
English translation of Japanese Patent Application Publication No. JP 2015-31187A (Year: 2015).*
English translation of Japanese Patent No. JP 5796278B2 (Year: 2015).*
International Search Report and Written Opinion for related JP App. No. PCT/JP2018/045070 dated Feb. 19, 2019. English translation provided; 10 pages.

* cited by examiner

INTERNAL COMBUSTION ENGINE EXHAUST PURIFICATION DEVICE

CROSS-REFERENCE TO RELATED APPLICATIONS

This application is a U.S. National Stage entry of PCT Application No: PCT/JP2018/045070 filed Dec. 7, 2018, which claims priority to Japanese Patent Application No. 2017-244237 filed Dec. 20, 2017, the contents of which are incorporated herein by reference.

TECHNICAL FIELD

The present disclosure relates to an internal combustion engine exhaust purification device, and more particularly to an exhaust purification device including a filter which collects particulate matter in exhaust gas.

BACKGROUND ART

For example, an exhaust purification device for a diesel engine generally includes a filter which collects particulate matter (PM) in exhaust gas. In a case where a certain amount or more of PM has been accumulated on a filter, the filter is regenerated to burn and remove the accumulated PM. During the filter regeneration, an additional fuel for raising a temperature is injected and supplied into an exhaust path from an injection valve provided upstream of the filter in the exhaust path (for example, see Patent Literatures 1 and 2).

CITATION LIST

Patent Document

Patent Literature 1: JP-A-2014-159780
Patent Literature 2: JP-A-2016-89775

SUMMARY OF THE INVENTION

Technical Problem

When the filter is regenerated, a temperature of the filter may rise to an abnormally high temperature. If this temperature rise is allowed as it is, it may lead to burnout of the filter, which is not preferable.

Therefore, in a case where the temperature of the filter rises abnormally, it is conceivable to stop the fuel injection from the injection valve and to prevent the temperature of the filter from rising.

However, when a failure that the injection valve does not close, that is, an opened adherence failure occurs in the injection valve, the fuel injection from the injection valve cannot be substantially stopped. Therefore, the temperature of the filter cannot be prevented from rising, and the filter may be burnt.

An object of the present disclosure is to provide an internal combustion engine exhaust purification device that enables to prevent a filter from being burnt due to abnormal temperature rise of the filter during filter regeneration.

Solution to Problem

The technique according to the present disclosure provides an internal combustion engine exhaust purification device including:

a filter that is provided in an exhaust path, and collects particulate matter in exhaust gas;

an injection valve that is provided upstream of the filter in the exhaust path, and injects a fuel into the exhaust path;

a fuel pump that supplies a fuel to the injection valve;

a shut-off valve that is interposed between the fuel pump and the injection valve, and selectively shuts off a fuel supply from the fuel pump to the injection valve; and a control unit configured to control the injection valve and the shut-off valve, in which the control unit closes the shut-off valve when the control unit detects an opened adherence failure of the injection valve and detects an abnormal temperature rise of the filter during regeneration of the filter.

Preferably, the control unit opens the shut-off valve when the control unit does not detect the opened adherence failure of the injection valve or does not detect the abnormal temperature rise of the filter during the regeneration of the filter.

Preferably, the control unit closes the shut-off valve while the filter is not being regenerated.

Preferably, the exhaust purification device further includes:

a common rail; and a high-pressure pump that supplies a high-pressure fuel to the common rail, in which the fuel pump supplies a fuel to both the injection valve and the high-pressure pump.

Advantageous Effects of Invention

According to the above-described technique in the present disclosure, it is possible to provide the internal combustion engine exhaust purification device that enables to prevent the filter from being burnt due to abnormal temperature rise of the filter during filter regeneration.

DESCRIPTION OF EMBODIMENTS

An internal combustion engine exhaust purification device according to an embodiment of the present disclosure will be described below with reference to the accompanying drawings. Note that the present disclosure is not limited to the following embodiment.

Figure 1:
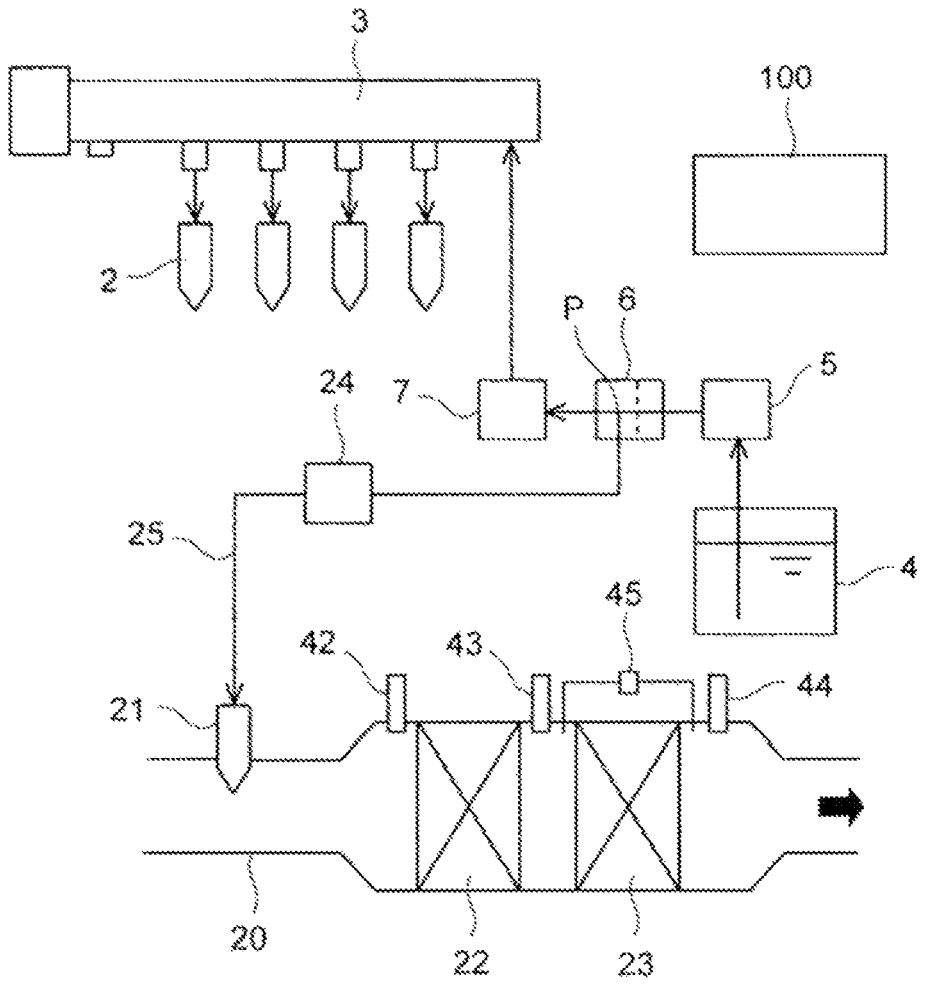
FIG. 1 is a schematic view illustrating a configuration of an internal combustion engine exhaust purification device according to an embodiment.

FIG. 1 is a schematic view illustrating a configuration of an internal combustion engine exhaust purification device according to an embodiment. An internal combustion engine (an engine) according to the present embodiment is a compression ignition internal combustion engine, that is, a diesel engine, mounted on a vehicle (not illustrated) as a power source. The vehicle is a large vehicle which is a truck or the like. However, a type and a use of the vehicle and the internal combustion engine are not particularly limited. For example, the vehicle may be a small vehicle which is a passenger car or the like, and the engine may be a gasoline engine. The present embodiment describes a case of an in-line four-cylinder engine. However, a cylinder arrangement form of the engine, the number of cylinders, and the like are selected freely.

The engine includes a common rail fuel injection device, and includes in-cylinder injectors 2 for cylinders that directly inject fuel into the cylinders, and a common rail 3 connected to each in-cylinder injector 2. The common rail 3 stores a high-pressure fuel injected from the in-cylinder injector 2.

The engine includes a fuel tank 4 which stores fuel at a normal pressure, a feed pump 5 which suctions fuel from the fuel tank 4 and to discharge the fuel at a relatively low pressure (for example, approximately 1 MPa), a supply pump 7 to which the fuel discharged from the feed pump 5 is supplied, and a fuel filter 6 which is provided between the feed pump 5 and the supply pump 7 and filters the fuel before the fuel enters the supply pump 7. The supply pump 7 pressurizes a low-pressure fuel supplied from the feed pump 5 to a higher pressure (for example, approximately 200 MPa at maximum) and supplies the pressurized fuel to the common rail 3. Therefore, the supply pump 7 is a high-pressure pump which supplies a high-pressure fuel to the common rail 3.

In an exhaust path 20 of the engine, an injection valve which injects a fuel into the exhaust path 20, that is, an exhaust injector 21, an oxidation catalyst 22, and a filter 23 are provided sequentially from an upstream side. Each of the oxidation catalyst 22 and the filter 23 is a post-processing member which performs exhaust post-processing.

The oxidation catalyst 22 oxidizes and purifies unburned components (hydrocarbons HC and carbon monoxide CO) in exhaust gas, and heats and raises a temperature of the exhaust gas with reaction heat at this time. The filter 23 is also referred to as a continuous regeneration diesel particulate filter (DPF), and collects particulate matter (also referred to as PM) contained in the exhaust gas and to reacts the collected PM with a catalytic noble metal to continuously burn and remove the collected PM. As the filter 23, a so-called wall flow type filter is used in which openings at both ends of a honeycomb structure base material are alternately closed in a checkered pattern.

Although not illustrated, as another post-processing member, a selective reduction NOx catalyst (SCR) and an ammonia oxidation catalyst may be provided downstream of the filter 23 sequentially from the upstream side. In this case, an addition valve which adds urea water into the exhaust path 20 as a reducing agent is provided upstream of the NOx catalyst. The NOx catalyst may be an occlusion reduction NOx catalyst (LNT), in the case the addition valve can be omitted.

A fuel is supplied to the exhaust injector 21 from the feed pump 5. Therefore, the feed pump 5 corresponds to a fuel pump in the claims. In the present embodiment, the low-pressure fuel that has been filtered by the fuel filter 6 is branched at a branch position P in the fuel filter 6 and is supplied to the exhaust injector 21. Therefore, the feed pump 5 supplies the fuel to both the exhaust injector 21 and the supply pump 7. The fuel is also supplied to the exhaust injector 21 using the feed pump 5 which originally supplies the fuel to the supply pump 7. Therefore, it is possible to reduce the number of components and to reduce manufacturing cost as compared with those in a case where a dedicated fuel pump is provided for the exhaust injector 21.

The branch position P of the fuel does not have to be in the fuel filter 6, and may be, for example, outside the fuel filter 6, downstream of the fuel filter 6 and upstream of the supply pump 7.

In the present embodiment, a shut-off valve 24 is interposed between the feed pump 5 and the exhaust injector 21. The shut-off valve 24 selectively shuts oft the fuel supply from the feed pump 5 to the exhaust injector 21, and is also referred to as a fuel cut valve (FCV). In the present embodiment, the shut-off valve 24 is provided in a fuel flow path 25 between the branch position P in the fuel filter 6 and the exhaust injector 21.

A control device which controls the engine is mounted on a vehicle. The control device includes an electronic control unit (referred to as an ECU) 100 that is a control unit or a controller. The ECU 100 includes a CPU, a ROM, a RAM, an input and output port, a storage device, and the like. The ECU 100 is configured and programmed to control the in-cylinder injector 2, the supply pump 7, the exhaust injector 21, and the shut-off valve 24. Each of the in-cylinder injector 2, the exhaust injector 21, and the shut-off valve 24 is opened when turned on by the ECU 100, and is closed when turned off by the ECU 100. However, the shut-off valve 24 may be reversed.

The control device also includes the following sensors. That is, exhaust gas temperature sensors 42, 43 for detecting an exhaust gas temperature (an inlet gas temperature) at inlets of the oxidation catalyst 22 and the filter 23, an exhaust gas temperature sensor 44 for detecting an exhaust gas temperature (an outlet gas temperature) at an outlet of the filter 23, and a differential pressure sensor 45 for detecting a differential pressure (a front-rear differential pressure) of exhaust pressures at the inlet and the outlet of the filter 23 are provided. Output signals of these sensors are sent to the ECU 100.

The ECU 10 performs filter regeneration (or filter regeneration control, or the like) so as to burn and remove PM accumulated on the filter 23 and regenerate the filter 23. Here, the filter regeneration is roughly classified into manual regeneration that is performed when a manual regeneration switch (not illustrated) is turned on by a driver, and automatic regeneration that is performed automatically in a state (off state) where the manual regeneration switch is not turned on. In the following description, unless otherwise specified, reference to the filter regeneration means both the manual regeneration and the automatic regeneration.

When an actual differential pressure P detected by the differential pressure sensor 45 becomes a predetermined start threshold value P1 or higher, a relatively large amount of PM or nearly full PM has been accumulated on the filter 23, so that the ECU 100 starts the filter regeneration (the automatic regeneration) so as to burn and remove PM. During the filter regeneration, the ECU 100 opens the shut-off valve 24 to enable fuel supply to the exhaust injector 21, and opens a valve of the exhaust injector 21 to inject the fuel from the exhaust injector 21. Then, the injected fuel is oxidized and burned by the oxidation catalyst 22, high-temperature exhaust gas is discharged from the oxidation catalyst 22, and the high-temperature exhaust gas is supplied to the filter 23. Then, a temperature of the filter 23 is raised, and the accumulated PM is burned and removed in the filter 23 by a catalytic reaction. During the filter regeneration, the exhaust injector 21 is duty-controlled by the ECU 100, and is repeatedly opened and closed (turned on and turned off) for each short duty cycle.

After that, when the actual differential pressure P detected by the differential pressure sensor 45 becomes a predetermined end threshold value P2 (<P1) or lower, the accumulated PM is substantially removed and an amount thereof becomes relatively small or near empty, so that the ECU 100 ends the filter regeneration. When the filter is not regenerated after an end of the filter regeneration, that is, when the filter regeneration is stopped, the ECU 100 closes the shut-off valve 24 to shut off the fuel supply to the exhaust injector 21, and closes the valve of the exhaust injector 21 to stop the fuel injection from the exhaust injector 21.

In a comparative example, assuming that the shut-off valve 24 is not provided, the fuel injection from the exhaust injector 21 is stopped only by closing the valve of the exhaust injector 21 when the filter regeneration is stopped. However, a fuel pressure from the feed pump 5 is constantly applied to the exhaust injector 21. Due to this fuel pressure, a small amount of fuel may leak out from minute injection holes of the exhaust injector 21 exposed in the exhaust path 20, and the leaked fuel may be heated by the high-temperature exhaust gas, carbonized, and accumulated in a vicinity of the injection holes. Due to an influence of the accumulated carbonized fuel, a failure that the valve of the exhaust injector 21 is not closed completely, that is, an opened adherence failure may occur. When the opened adherence failure occurs, even when the ECU 100 sends a valve closing instruction signal (an OFF signal) to the exhaust injector 21, the valve of the exhaust injector 21 cannot be physically closed, and an unintended fuel is supplied from the exhaust injector 21.

As is well known, the exhaust injector 21 opens and closes the injection holes by bringing a needle valve into and out of close contact with a nozzle body. Even if the needle valve is brought into close contact with the nozzle body when the injection holes are closed, if a pressurized fuel is sent from an upstream side thereof, the fuel leaks out from a slight gap between the needle valve and the nozzle body. On the other hand, the carbonized fuel may be accumulated in the vicinity of the injection holes in the nozzle body. A part of the carbonized fuel is trapped between the needle valve and the nozzle body, and the opened adherence failure occurs in which the needle valve is not completely in close contact with the nozzle body.

Therefore, in the present embodiment, the shut-off valve 24 is provided so as to present the opened adherence failure. When the shut-off valve 24 is provided, the shut-off valve 24 is closed when the filter regeneration is stopped, so that it is possible to shut off the fuel pressure application and the fuel supply from the feed pump 5 to the exhaust injector 21. Therefore, it is possible to reliably prevent the fuel from leaking out from the injection holes of the exhaust injector 21 when the valve of the exhaust injector 21 is closed. There is no fuel pressure, so that a possibility that of leakage is greatly reduced. Even if the leakage occurs, a maximum amount of the leakage is limited to an amount accumulated in the fuel flow path 25 between the shut-off valve 24 and the exhaust injector 21. Therefore, it is possible to reliably prevent the carbonized fuel from being accumulated in the vicinity of the injection holes due to the leaked fuel and the opened adherence failure that occurs due to the influence of the accumulated carbonized fuel.

Even in a case where the shut-off valve 24 is provided, a possibility of the opened adherence failure of the exhaust injector 21 due to another cause (for example, an electrical failure) cannot be said to be zero. Rather, from a viewpoint of an on-board diagnosis (OBD: vehicle self-diagnosis), it is desirable to anticipate this failure and to cope with this failure.

During the filter regeneration, a temperature of the filter 23 may rise to an abnormally high temperature. There are various causes of this abnormal temperature rise. For example, the manual regeneration and the automatic regeneration cannot be performed in a well-coordinated manner due to convenience of the driver or the like, and an excessive amount of PM is accumulated on the filter 23, which burns all at once during high-load operation or the like.

If this abnormal temperature rise is allowed as it is, it may lead to burnout of the filter 23, which is not preferable. Therefore, in a case where the temperature of the filter 23 rises abnormally, it is conceivable to control the exhaust injector 21 to close (turn off) the valve of the exhaust injector 21, to forcibly stop the fuel injection from the exhaust injector 21, and to prevent the temperature of the filter from rising.

However, in a case of the comparative example in which the above-described opened adherence failure has occurred in the exhaust injector 21 and the shut-off valve 24 is not provided, the fuel injection from the exhaust injector 21 cannot be substantially stopped. Therefore, the temperature of the filter 23 cannot be prevented from rising, and the filter 23 may be burnt.

Therefore, in the present embodiment, in order to solve this problem, the following control is performed.

First, the ECU 100 according to the present embodiment has a self-diagnosis function, and is configured to detect the opened adherence failure of the exhaust injector 21. Any method including a known method can be used as the detection method. For example, during the filter regeneration, when the inlet gas temperature (that is, the outlet gas temperature of the oxidation catalyst 22) of the filter 23 detected by the exhaust gas temperature sensor 43 is higher than a normal value of the exhaust injector 21 by a predetermined value or higher, the ECU 100 may determine that a larger amount of the fuel is being injected than that in a normal state, and may detect the opened adherence failure of the exhaust injector 21. Alternatively, in a case where the ECU 100 receives a feedback current corresponding to the valve opening from the exhaust injector 21 despite a fact that the valve closing instruction signal (the OFF signal) is sent to the exhaust injector 21, the ECU 100 may determine that the exhaust injector 21 is energized due to the electrical failure, and may detect the opened adherence failure of the exhaust injector 21.

The ECU 100 estimates a temperature (a floor temperature) Tf of the filter 23 based on at least one of the inlet gas temperature of the filter 23 detected by the exhaust gas temperature sensor 43 and the outlet gas temperature of the filter 23 detected by the exhaust gas temperature sensor 44. Any method including a known method can be used as the estimation method. For example, an average value of the inlet gas temperature and the outlet gas temperature of the filter 23 may be set as the filter temperature Tf or the outlet gas temperature of the filter 23 may be set as the filter temperature Tf. The filter temperature Tf may be directly detected by a temperature sensor provided in the filter 23. For convenience, both the estimation and the detection are collectively referred to as detection.

When the estimated filter temperature Tf is a predetermined abnormality determination value Tlim or higher, the ECU 100 detects the abnormal temperature rise of the filter 23. The abnormality determination value Tlim is set to a minimum value of the filter temperature. When the filter temperature, which is the abnormality determination value Tlim or higher, continues for predetermined time or longer, the filter 23 is burnt.

Figure 2:
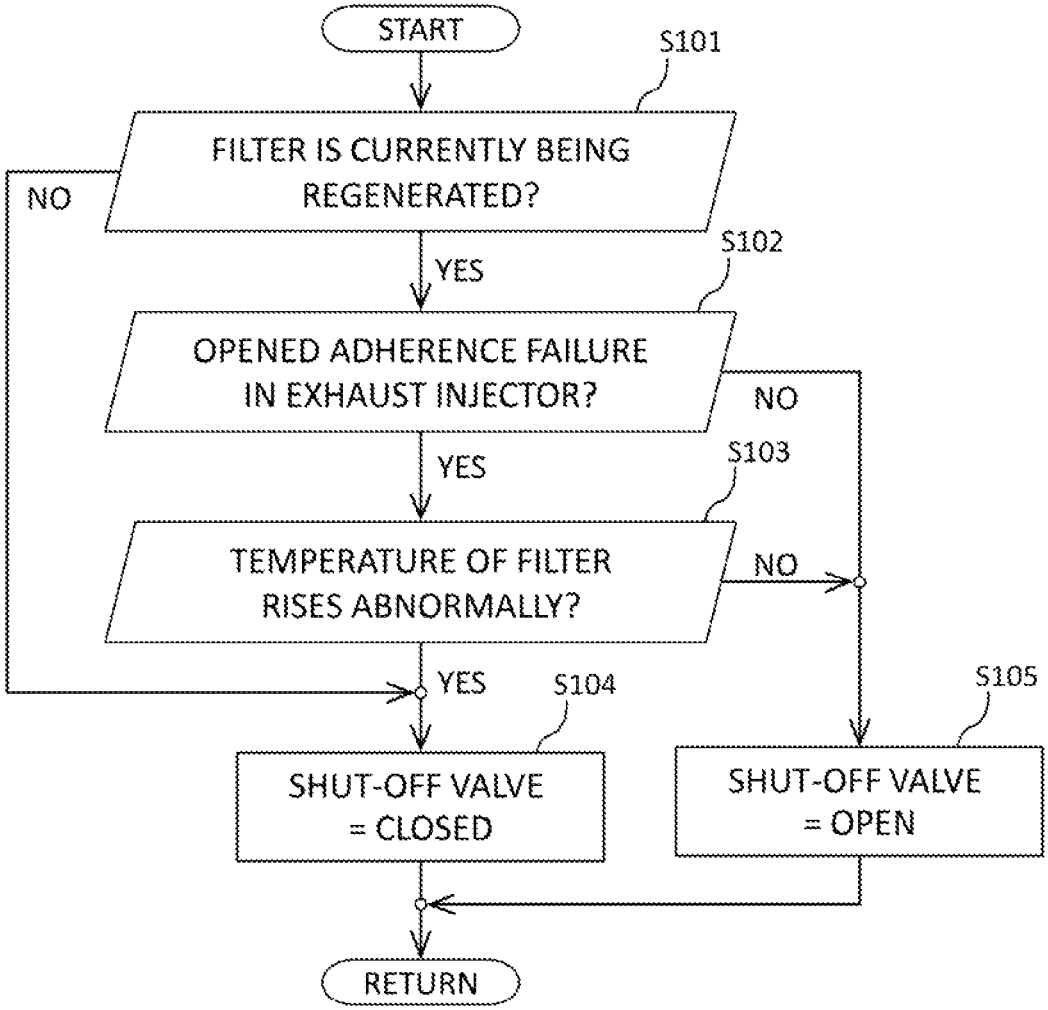
FIG. 2 is a flowchart of a control routine.

Next, a control routine according to the present embodiment will be described with reference to FIG. 2. This routine is repeatedly performed by the ECU 100 at every predetermined calculation cycle r (for example, 10 ms).

First, in step S101, the ECU 100 determines whether the current is at the time of the filter regeneration, that is, whether the filter is currently being regenerated.

In a case where the filter is not being regenerated, the ECU 100 proceeds to step S104 to close the shut-off valve. Accordingly, it is possible to shut off the fuel pressure application to the exhaust injector 21 and the fuel supply to the exhaust injector 21 when the filter is not being regenerated, and to prevent the carbonized fuel accumulation in the exhaust injector 21 and the opened adherence failure of the exhaust injector 21 due to the carbonized fuel accumulation.

On the other hand, in a case where the filter is being regenerated, the ECU 100 proceeds to step S102 and determines whether the opened adherence failure of the exhaust injector 21 has been detected, in other words, whether detection of the opened adherence failure has already finished.

In a case where the opened adherence failure has been detected, the ECU 100 proceeds to step S103 and determines whether the abnormal temperature rise of the filter 23 has been detected, in other words, whether the estimated filter temperature Tf has reached the abnormality determination value Tlim or higher.

In a case where the abnormal temperature rise of the filter 23 has been detected, the ECU 100 proceeds to step S104, closes the shut-off valve 24, and ends the routine. It is preferable that the exhaust injector 21 is also closed in conjunction with the closing of the shut-off valve 24.

On the other hand, in a case where the opened adherence failure of the exhaust injector 21 is not detected in step S102 or the abnormal temperature rise of the filter 23 is not detected in step S103, the ECU 100 proceeds to step S105, opens the shut-off valve 24, and ends the routine. In this case, the valve of the exhaust injector 21 is opened naturally.

In this way, the ECU 100 closes the shut-off valve 24 (S104) when the ECU 100 detects the opened adherence failure of the exhaust injector 21 (S102: yes) and detects the abnormal temperature rise of the filter 23 (S103: yes) during the regeneration of the filter 23 (S101: yes). Therefore, even in a case where the opened adherence failure of the exhaust injector 21 occurs, by closing the shut-off valve 24, it is possible to stop the fuel injection from the exhaust injector 21, and to prevent the temperature of the filter 23 from rising. Therefore, it is possible to reliably prevent the filter 23 from being burnt.

The ECU 100 opens the shut-off valve 24 (S105) when the ECU100 does not detect the opened adherence failure of the exhaust injector 21 (S102: no) or does not detect the abnormal temperature rise of the filter 23 (S103: no) during the regeneration of the filter 23 (S101: yes). In a case where the opened adherence failure of the exhaust injector 21 is not detected, the opened adherence failure does not occur and the fuel can be injected normally from the exhaust injector 21, so that it is possible to smoothly supply the fuel necessary for the fuel injection to the exhaust injector 21 by opening the shut-off valve 24 in this case. In a case where the abnormal temperature rise of the filter 23 is not detected, there is no problem with the fuel injection from the exhaust injector 21 as usual, so that the fuel necessary for the fuel injection can be smoothly supplied to the exhaust injector 21 by opening the shut-off valve 24 in this case.

In the present embodiment, the ECU 100 opens the shut-off valve 24 (S105) in a case where the ECU 100 does not detect the abnormal temperature rise of the filter 23 (S103: no) even when the ECU 100 detects the opened adherence failure of the exhaust injector 21 (S102: yes) during the regeneration of the filter 23 (S101: yes). In this case, since the opened adherence failure of the exhaust injector 21 has occurred, a larger amount of the fuel is injected from the exhaust injector 21 than that in the normal state. However, the abnormal temperature rise of the filter 23 has not occurred, so that there is still room for the temperature of the filter 23 to be raised, and there is a margin up to a temperature rise limit. Therefore, in this case, the temperature rise is prioritized over protection of the filter 23, and the shut-off valve 24 is opened to inject the fuel from the exhaust injector 21. Accordingly, even in the case where the opened adherence failure of the exhaust injector 21 has been detected, the filter regeneration can still be continued.

In the present embodiment, although not shown, the ECU 100 opens the shut-off valve 24 in a case where the ECU 100 does not detect the opened adherence failure of the exhaust injector 21 even when the ECU 100 detects the abnormal temperature rise of the filter 23 during the regeneration of the filter 23. Instead of closing the shut-off valve 24, the ECU 100 sends the valve closing instruction signal to the exhaust injector 21 to close the valve of the exhaust injector 21, and stops the fuel injection from the exhaust injector 21. Accordingly, it is possible to prevent the temperature of the filter 23 from rising, and to prevent the filter 23 from being burnt.

Although the embodiment of the present disclosure has been described in detail above, various other embodiments may be considered.

(1) For example, the fuel injection device may not be the common rail fuel injection device which stores and injects the high-pressure fuel, and may be a normal fuel injection device which injects the low-pressure fuel.

(2) If the temperature of the filter 23 can be raised without the oxidation catalyst 22 during the filter regeneration, the oxidation catalyst 22 may be omitted.

The embodiments of the present disclosure are not limited to the above-described embodiment, and all modifications, applications, and equivalents that fall within the concept of the present disclosure defined by the claims are included in the present disclosure. Accordingly, the present disclosure should not be construed as limited, and can be applied to any other technique belonging to the scope of the concept of the present disclosure.

The present application is based on a Japanese Patent Application (Japanese Patent Application No. 2017-244237) filed on Dec. 20, 2017, the contents of which are incorporated herein by reference.

INDUSTRIAL APPLICABILITY

The internal combustion engine exhaust purification device according to the present disclosure is useful in preventing the filter from being burnt due to abnormal temperature rise of the filter during filter regeneration.

LIST OF REFERENCE NUMERALS

5 feed pump (fuel pump)
20 exhaust path
21 exhaust injector (injection valve)
23 filter
24 shut-off valve
100 electronic control unit (control unit)

The invention claimed is:

1. An internal combustion engine exhaust purification device, comprising:

a filter that is provided in an exhaust path, and collects particulate matter in exhaust gas;

an injection valve that is provided upstream of the filter in the exhaust path, and injects a fuel into the exhaust path;

a fuel pump that supplies a fuel to the injection valve;

a shut-off valve that is interposed between the fuel pump and the injection valve, and selectively shuts off a fuel supply from the fuel pump to the injection valve; and a control unit configured to control the injection valve and the shut-off valve, wherein, during regeneration of the filter, the control unit is configured to:

close the shut-off valve when the control unit detects an opened adherence failure of the injection valve and detects an abnormal temperature rise of the filter; and open the shut-off valve when the control unit detects the opened adherence failure of the injection valve and does not detect the abnormal temperature rise of the filter.

2. The internal combustion engine exhaust purification device according to claim 1, wherein, during regeneration of the filter, the control unit is configured to open the shut-off valve when the control unit does not detect the opened adherence failure of the injection valve.

3. The internal combustion engine exhaust purification device according to claim 1, wherein the control unit closes the shut-off valve while the filter is not being regenerated.

4. The internal combustion engine exhaust purification device according to claim 1, further comprising:

a common rail; and a high-pressure pump that supplies a high-pressure fuel to the common rail, wherein the fuel pump supplies a fuel to both the injection valve and the high-pressure pump.

* * * * *